US009105423B2

(12) United States Patent
Kato et al.

(10) Patent No.: US 9,105,423 B2
(45) Date of Patent: Aug. 11, 2015

(54) MOUNTING PANEL STRUCTURE FOR A ROCKER SWITCH KNOB

(71) Applicants: Kojima Press Industry Co., Ltd, Toyota-shi, Aichi-ken (JP); TOYOTA BOSHOKU KABUSHIKI KAISHA, Kariya-shi, Aichi-ken (JP)

(72) Inventors: Yoshihiro Kato, Toyota (JP); Kenji Kiyosawa, Miyoshi (JP)

(73) Assignee: KOJIMA PRESS INDUSTRY CO., LTD, Kariya-Shi, Aichi-Ken (JP)

( * ) Notice: Subject to any disclaimer, the term of this patent is extended or adjusted under 35 U.S.C. 154(b) by 156 days.

(21) Appl. No.: 13/789,077

(22) Filed: Mar. 7, 2013

(65) Prior Publication Data

US 2013/0233684 A1 Sep. 12, 2013

(30) Foreign Application Priority Data

Mar. 9, 2012 (JP) ..... 2012-053509

(51) Int. Cl.

| | |
|---|---|
| ***H01H 13/70*** | (2006.01) |
| ***H01H 21/02*** | (2006.01) |
| ***H01H 23/08*** | (2006.01) |
| ***H01H 23/14*** | (2006.01) |
| *H01H 23/30* | (2006.01) |

(52) U.S. Cl.

CPC ..... *H01H 21/02* (2013.01); *H01H 23/08* (2013.01); *H01H 23/143* (2013.01); *H01H 23/30* (2013.01)

(58) Field of Classification Search

USPC ..... 200/339, 18, 329, 333, 335, 336, 200/343–345, 553

See application file for complete search history.

(56) References Cited

U.S. PATENT DOCUMENTS 5,693,920 A * 12/1997 Maeda ..... 200/1 B

FOREIGN PATENT DOCUMENTS

| | | |
|---|---|---|
| CN | 201601036 U | 10/2010 |
| JP | 2010-113978 | 5/2010 |

* cited by examiner

*Primary Examiner* — Vanessa Girardi

(74) *Attorney, Agent, or Firm* — Muncy, Geissler, Olds & Lowe, P.C.

(57) ABSTRACT

A mounting structure of a switch knob for a vehicle includes a panel 10 having an opening portion 11 and a switch knob 14 having a front surface 14*a* exposed through the opening portion 11. The panel 10 includes a pair of support portions 12 respectively extending upright on opposing edge portions of the opening portion 11 on the back surface 10*b* of the panel 10 in a direction perpendicular to the panel 10, and the switch knob 14 is pivotably supported by the support portions 12. Thus, there is provided a mounting structure of a switch knob for a vehicle, which is simple, with the number of components for mounting being reduced and in which a possibility of scratching a panel surface during the mounting operation can be reduced.

1 Claim, 7 Drawing Sheets

MOUNTING PANEL STRUCTURE FOR A ROCKER SWITCH KNOB

PRIORITY INFORMATION

This application claims priority to Japanese Patent Application No. 2012-053509, filed on Mar. 9, 2012, which is incorporated herein by reference in its entirety.

BACKGROUND

1. Technical Field

The present invention relates to a mounting structure of a switch knob for a vehicle.

2. Background Art

Conventionally, in the interior of a vehicle such as an automobile, switches are provided on an instrument panel and an overhead console in order to operate on-vehicle devices such as an air conditioner, an audio player, and the like.

FIG. 7 is a view illustrating one example conventional overhead console. An overhead console 7 illustrated in FIG. 7 includes a panel 70, an opening portion 71, and a switch knob 72. The surface of the overhead console 7 is covered with the panel 70. The panel 70 has the opening portion 71, and a surface of the switch knob 72 is exposed through the opening portion 71. The switch knob 72 is in contact with or adjacent to a switch, which is not shown, in the interior of the overhead console, so that a user can press the switch knob 72 to thereby press the switch on.

Concerning a mounting structure of a switch knob, the mounting structure as disclosed in JP 2010-113978 A is suggested, for example. In JP 2010-113978 A, after a panel is mounted, a switch knob is mounted to a knob guide which supports the switch knob, externally of the panel.

SUMMARY

Technical Problems

However, the mounting structure of a switch knob as described in JP 2010-113978 A suffers from the following problems. First, as the switch knob is mounted externally of the panel, there is a possibility that the panel surface is scratched or damaged during the mounting operation. Second, as the switch knob is mounted externally of the panel, it is difficult to mount the switch knob. While consideration may be given to mounting the switch knob before the panel is mounted, with this method, after a large number of switch knobs are mounted it is necessary to fix the panel so as to align opening portions of the panel provided corresponding to the respective switch knobs with the respective switch knobs, making the mounting operation correspondingly complicated. Third, it is necessary to provide a knob guide which is a member that supports the switch knob.

In view of the foregoing problems, an advantage of the present invention is to provide a mounting structure of a switch knob for a vehicle, which is simple and in which the number of components for mounting can be reduced and a possibility of scratching a panel surface during the mounting operation can be reduced.

Means for Solving the Problems (1) In accordance with an aspect of the invention, there is provided a mounting structure of a switch knob for a vehicle that presses a push switch, the mounting structure including a panel having an opening portion, and a switch knob having a front surface exposed through the opening portion, wherein the panel includes, on opposing edge portions of the opening portion, a pair of support portions extending upright from a back surface of the panel in a direction which is perpendicular to the panel, and the switch knob is pivotably supported by the pair of support portions.

(2) In the mounting structure of a switch knob for a vehicle described in the above (1), the switch knob is pivotably supported by the pair of support portions such that the switch knob can pivot without interfering with the panel.

Advantageous Effects

According to the present invention, it is possible to mount a switch knob for a vehicle simply, with a lower possibility of scratching or damaging a panel surface during the mounting operation. Further, it is possible to reduce the number of components required for mounting the switch knob for a vehicle.

BRIEF DESCRIPTION OF THE DRAWINGS

A preferred embodiment of the present invention will be described in detail based on the following figures, wherein.

DESCRIPTION OF EMBODIMENTS

A preferred embodiment of the present invention will be described, using an example in which a mounting structure of a switch knob according to the present invention is employed in an overhead console. However, the following embodiment is only an example and the present invention is not limited thereto.

Figure 1:
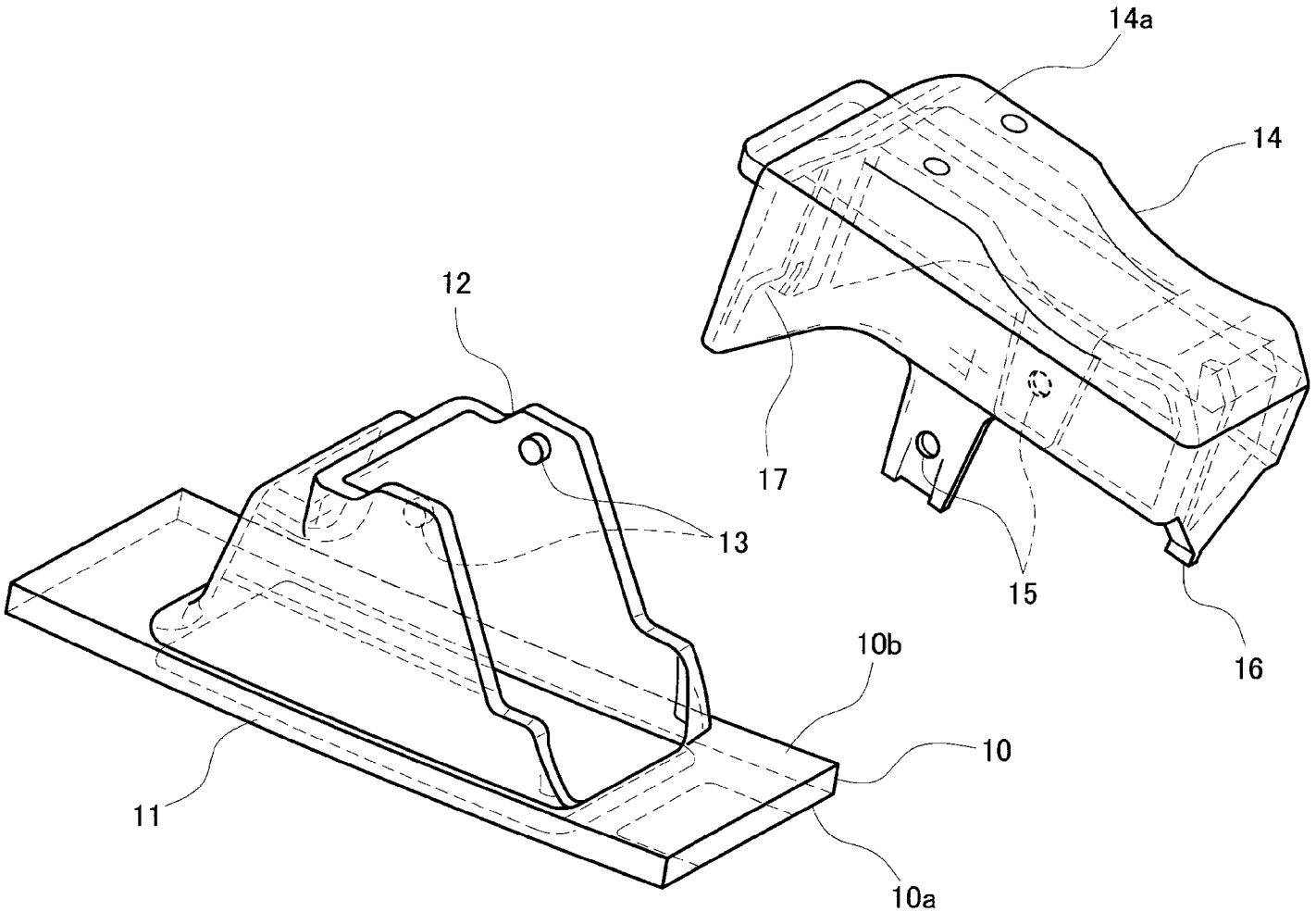
FIG. 1 is a perspective view illustrating a panel 10 and a switch knob 14 according to an embodiment of the present invention.

FIG. 1 is a perspective view illustrating a panel 10 and a switch knob 14 according to an embodiment of the present invention. The mounting structure of a switch knob for a vehicle according to the embodiment of the present invention is configured by including the panel 10 and the switch knob 14.

The panel 10 is a designed panel that covers a surface of an overhead console, and only a part of the panel 10 is illustrated in FIG. 1. The panel 10 includes a front surface 10*a* and a back surface 10*b*, the front surface 10*a* being a designed surface. Further, the panel 10 includes an opening portion 11 formed through the panel 10. Further, the panel 10 includes, on opposing edge portions of the opening portion 11, a pair of support portions 12 extending upright from the back surface 10*b* of the panel 10 in the direction perpendicular to the panel 10. The support portions 12 are preferably molded integrally with the panel 10. Each support portion 12 includes, near the leading end thereof, a boss 13.

The switch knob 14 is a so-called seesaw switch knob, which presses two switches. The switch knob 14 includes a front surface 14*a* which is a designed surface, and two press portions 16 and 17. Further, the switch knob 14 includes holes 15 into which the bosses 13 fit.

Figure 2:
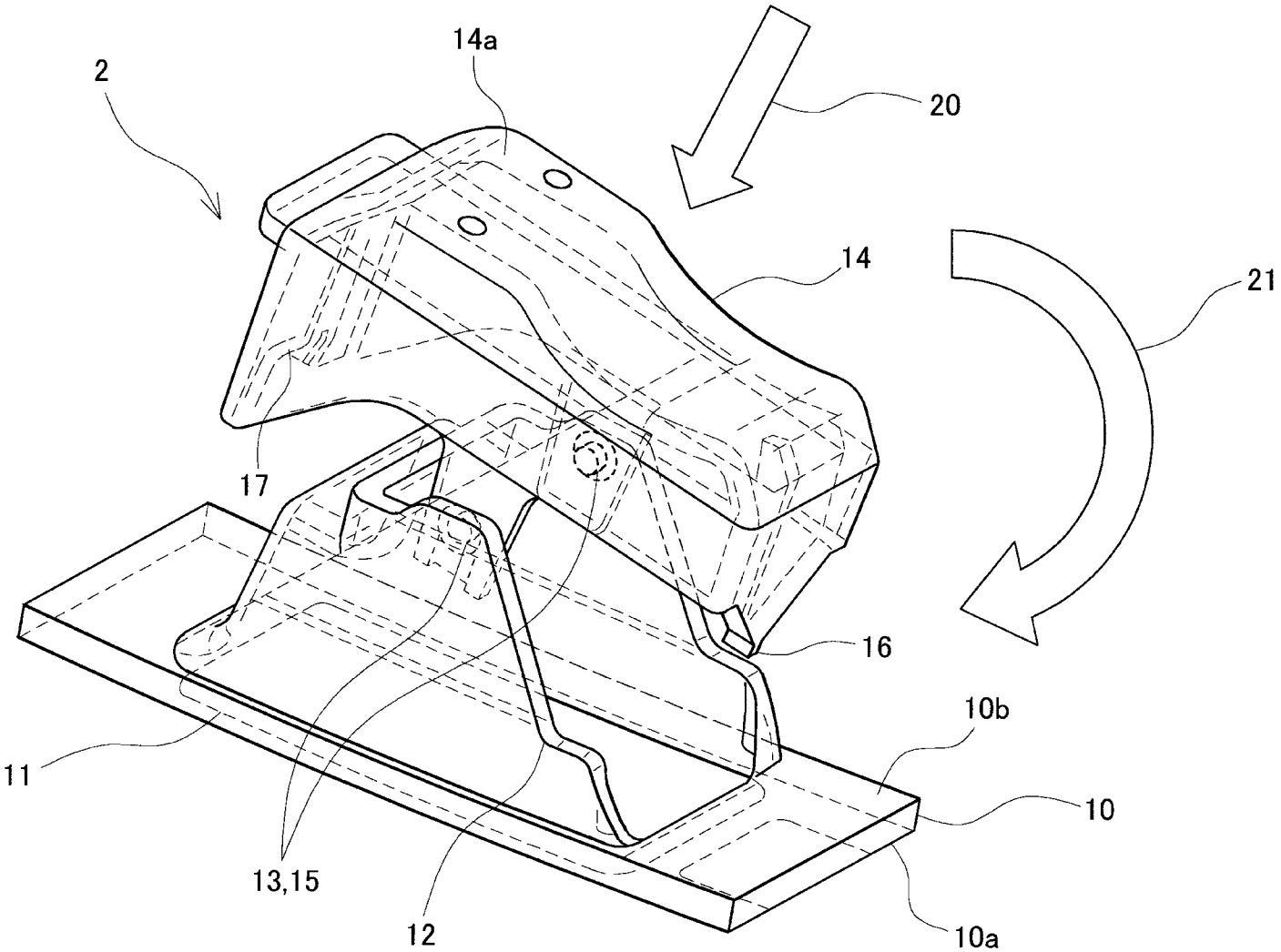
FIG. 2 is a view illustrating a state of mounting the switch knob 14 in a mounting structure 2 of a switch knob for a vehicle according to the embodiment of the present invention.

FIG. 2 is a view illustrating a state in which the switch knob 14 is to be mounted in the mounting structure 2 of a switch knob for a vehicle according to the embodiment of the present invention. As illustrated in FIG. 2, the switch knob 14 is mounted, in a state in which the panel 10 is placed with the front surface 10*a* directed downward and the front surface 14*a* of the switch knob 14 is directed upward. In such a direction, the switch knob 14 is moved in the direction indicated by an arrow 20 to make the bosses 13 provided on the respective support portions 12 fit into the holes 15 formed on the respective sides of the switch knob 14. Consequently, the switch knob 14 is supported by the panel 10 with the two bosses 13 functioning as fulcrums, so that the switch knob 14 can pivot about the bosses 13. While in the present embodiment the bosses 13 are provided on the panel 10 and the holes 15 are provided on the switch knob 14, the holes may be provided on the panel 10 and the bosses provided on the switch knob 14. Also, while in the present embodiment the panel 10 includes two support portions 12 and the two bosses 13 are provided on the respective support portions 12 and the two holes 15 are provided on the switch knob 14, the bosses 13 and the holes 15 may be modified to increase the lengths thereof, for example, to thereby form one support portion 12, one boss 13, and one hole 15.

Figure 3:
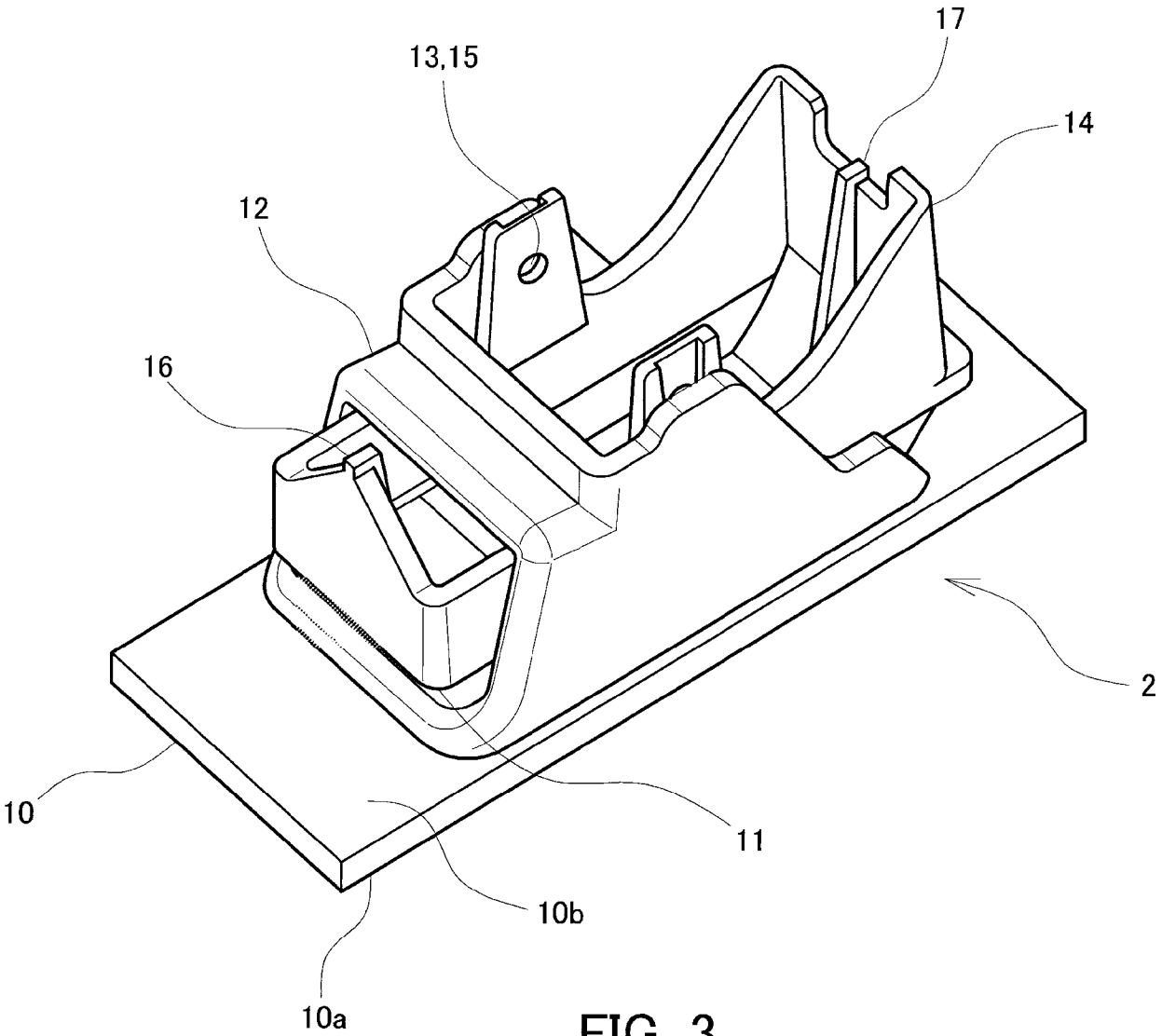
FIG. 3 is a view illustrating a positional relationship between the panel 10 and the switch knob 14 after the switch knob 14 is rotated.

Thereafter, by rotating the switch knob 14 in the direction of an arrow 21, the front surface 14*a* of the switch knob 14 is directed downward and is exposed through the opening portion 11 of the panel 10. FIG. 3 illustrates the positional relationship between the panel 10 and the switch knob 14 after the switch knob 14 is rotated.

Figure 4:
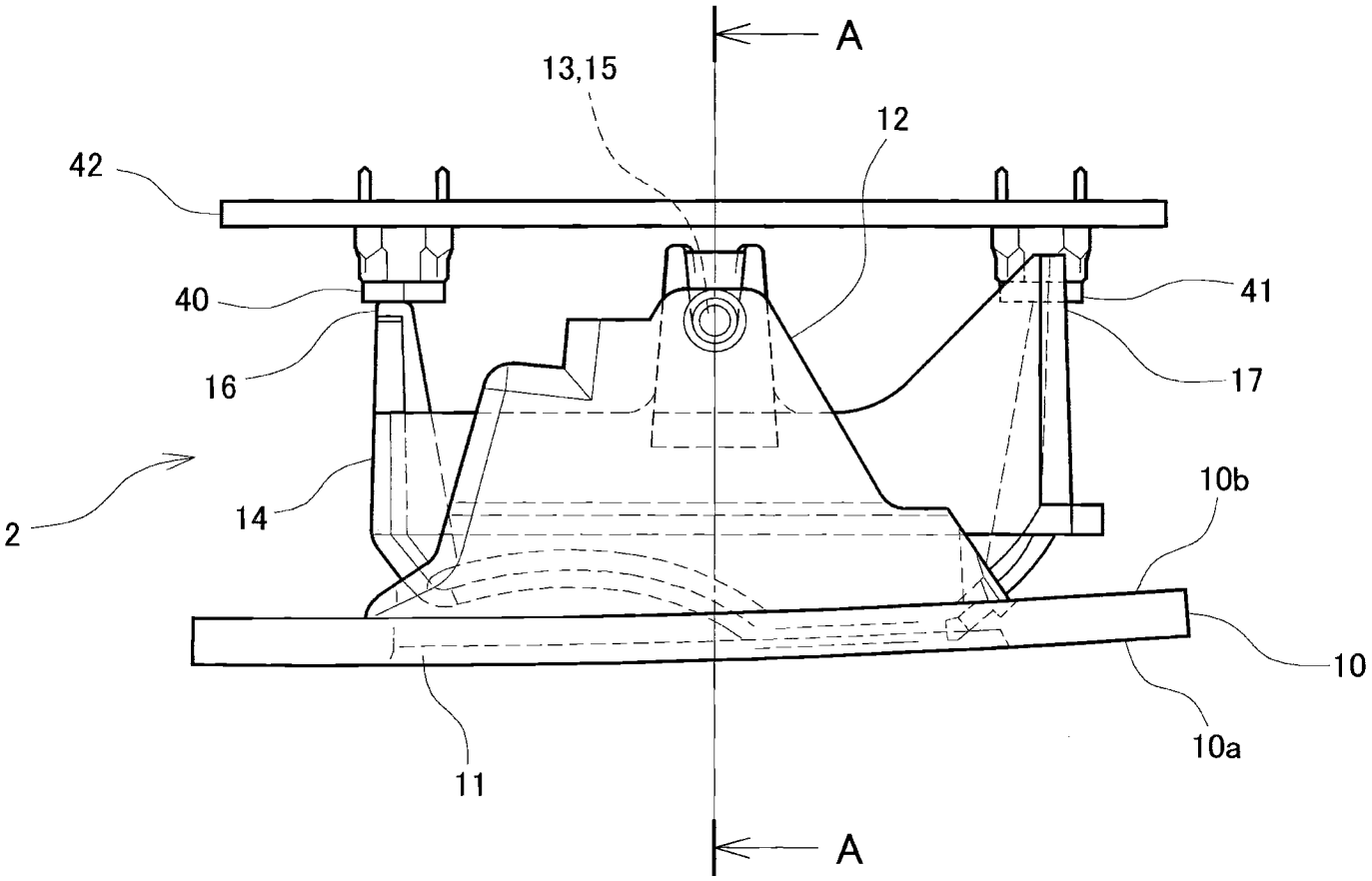
FIG. 4 is a front view illustrating the mounting structure 2 of a switch knob for a vehicle and peripheral members according to the embodiment of the present invention.
Figure 5:
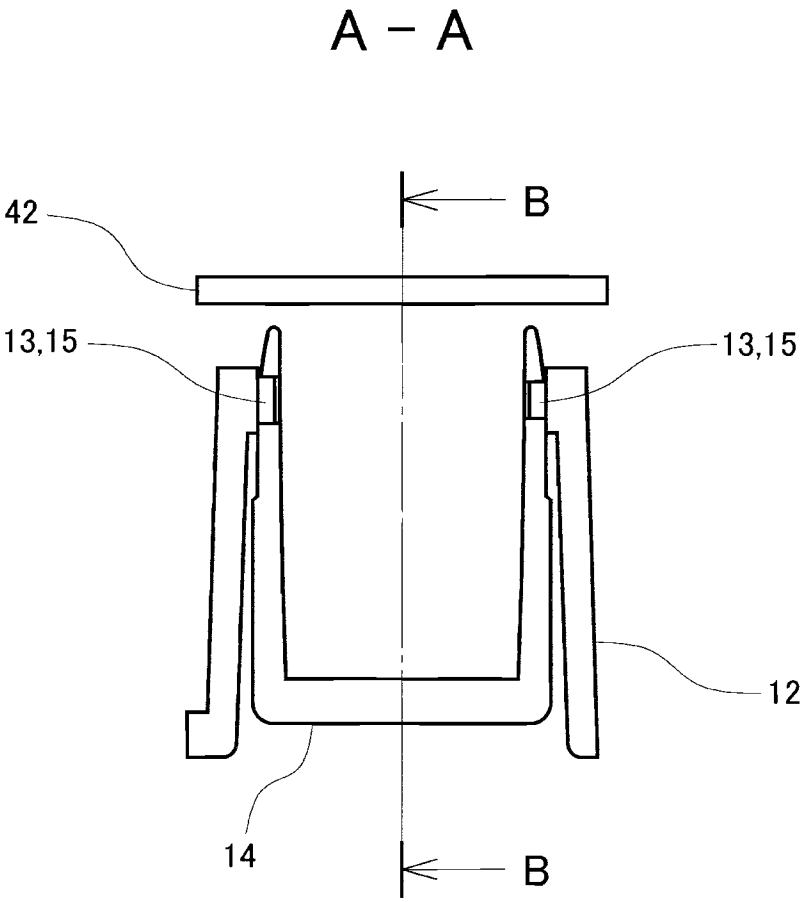
FIG. 5 is a cross sectional view taken along line A-A in FIG. 4.

FIG. 4 is a front view illustrating the mounting structure 2 of a switch knob for a vehicle according to the present embodiment and peripheral members. Further, FIG. 5 is a cross sectional view taking along A-A of FIG. 4. The peripheral members include two switches 40 and 41, and a substrate 42.

The two switches 40 and 41 are push switches that are mounted on the substrate 42 by soldering and the like, and function as switches when depressed from below in a state in which they are mounted in the direction as illustrated in FIG. 4. The panel 10 and the switch knob 14 are disposed near the switches 40 and 41 such that the press portions 16 and 17 of the switch knob 14 can press the two switches 40 and 41, respectively. When the user presses the switch knob 14, the switch knob 14 pivots about the bosses 13 to thereby press the switches 40 and 41.

Figure 6:
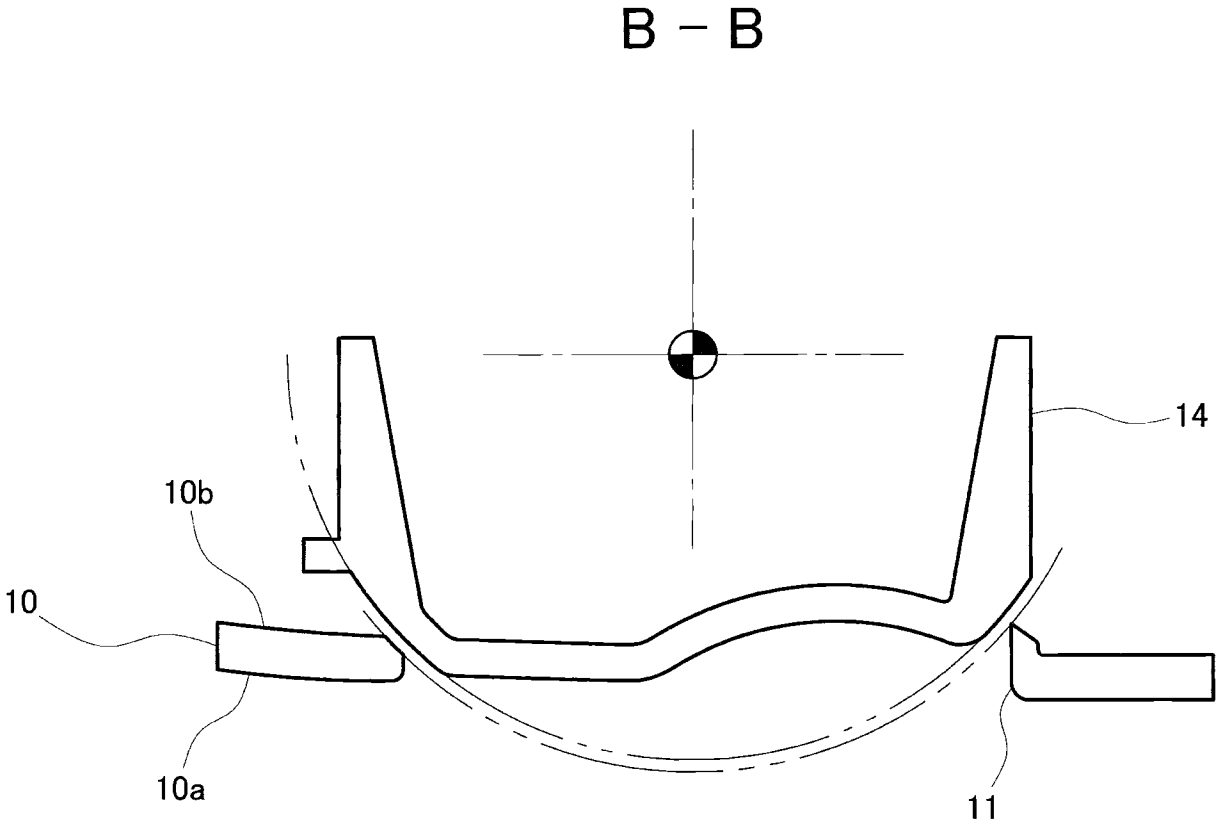
FIG. 6 is a cross sectional view taken along line B-B in FIG. 5.
Figure 7:
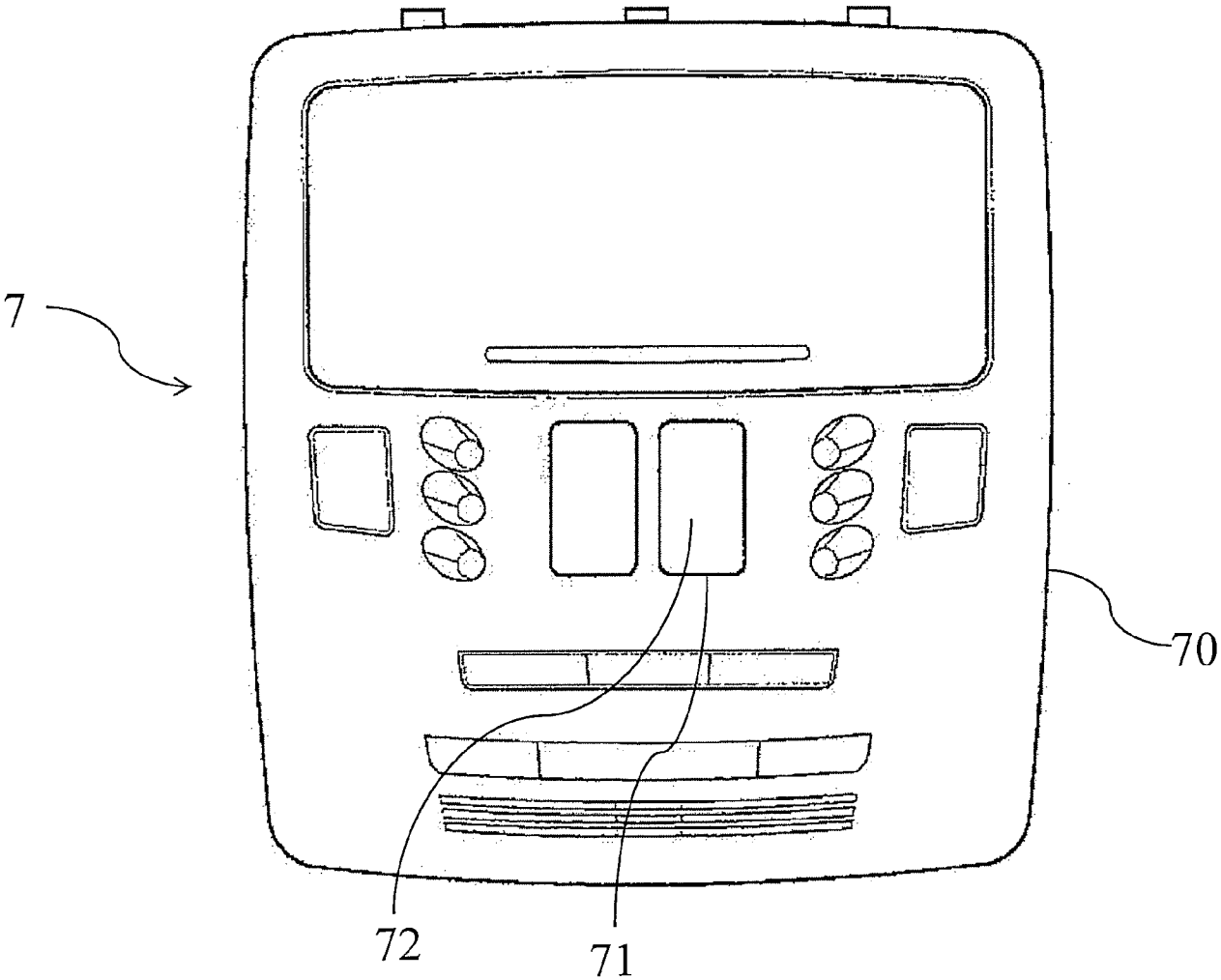
FIG. 7 is a view illustrating an example conventional overhead console.

FIG. 6 is a cross sectional view taken along line B-B of FIG. 5. In FIG. 6, the switches 40 and 41, and the substrate 42 are not illustrated. As illustrated in FIG. 6, the switch knob 14 is mounted on the panel 10 such that the switch knob 14 does not interfere with the panel 10 when the switch knob 14 is pivoted about the bosses 13. With this configuration, the front surface 14*a* of the switch knob 14 can be exposed through the opening portion 11, by mounting the switching knob 14 with the front surface 14*a* directed upward and thereafter rotating the switch knob 14. Accordingly, the switch knob 14 is mounted such that the switch knob 14 does not interfere with the panel 10 at least from the position at which the switch knob 14 is attached to the support portions 12 to the position at which the front surface 14*a* is exposed through the opening portion 11 as illustrated in FIG. 3.

The mounting structure 2 of a switch knob for a vehicle according to the present embodiment, which has the above-described configuration, can provide the following advantages.

First, as illustrated in FIG. 2, with the mounting structure 2 of a switch knob for a vehicle according to the present embodiment, as the switch knob 14 is mounted onto the bosses 13 formed on the support portions 12 which are provided on the back surface 10*b* of the panel 10 from the back side of the panel 10, it is possible to eliminate the possibility of scratching or damaging the front surface 10*a* which is a designed surface of the panel 10 during the mounting of the switch knob 14. Second, mounting the switch knob 14 from the back side of the panel 10 can facilitate the mounting operation of the switch knob 14. Facilitation of the mounting operation can further result in a reduction in the number of process steps required for the mounting, which leads to a cost reduction. Third, by molding the support portions 12 of the present embodiment integrally with the panel 10, the necessity of providing separate members for supporting the switch knob 14, such as a knob guide and the like, can be eliminated, and also the process step of assembling the knob guide can be omitted, which also leads to a cost reduction.

Further, with the configuration in which the switch knob 14 is mounted onto the support portions 12 with the front surface 14*a* thereof directed upward, it is possible to prevent scratching or damaging the front surface 14*a* of the switch knob 14 during the mounting of the switch knob 14.

While the preferred embodiment of the present invention has been described using specific terms, such description is for illustrative purposes only, and it is to be understood that changes and variations may be made without departing from the spirit or scope of the appended claims.

REFERENCE SYMBOL LIST

2 mounting structure of a switch knob for a vehicle, 7 overhead console, 10, 70 panel, 10*a*, 14*a* front surface, 10*b* back surface, 11, 71 opening portion, 12 support portion, 13 boss, 14, 72 switch knob, 15 hole, 16, 17 press portion, 20, 21 arrow, 40, 41 switch, 42 substrate.

What is claimed is:

1. A mounting structure of a switch knob for a vehicle that presses a push switch, the mounting structure comprising:

a panel having an opening portion; and a switch knob having a front surface, wherein the panel includes, on opposing edge portions of the opening portion, a pair of support portions extending from a back surface of the panel in a direction which is perpendicular to the panel, and wherein during mounting of the switch knob onto the panel, the switch knob is supported by the pair of support portions such that the front surface of the switch knob is not exposed through the opening portion of the panel until which time the switch knob is rotated, while supported, and the front surface of the switch knob is then exposed through the opening portion by the rotation movement.

* * * * *